US005581833A

United States Patent [19]

Zenoff

[11] Patent Number: 5,581,833

[45] Date of Patent: Dec. 10, 1996

[54] SUPPORT PILLOW WITH LUMBAR SUPPORT FOR USE IN NURSING AND OTHER APPLICATIONS

[76] Inventor: Andrew R. Zenoff, 2525 Baker St., San Francisco, Calif. 94123

[21] Appl. No.: 334,677

[22] Filed: Nov. 4, 1994

[51] Int. Cl.[6] ..... A47C 20/02

[52] U.S. Cl. ..... 5/655; 108/43; 5/633

[58] Field of Search ..... 5/655, 636, 637, 5/646, 648, 633; 108/43

[56] References Cited

U.S. PATENT DOCUMENTS

| | | | |
|---|---|---|---|
| D. 315,845 | 4/1991 | Lafley . | |
| D. 318,202 | 7/1991 | Weber . | |
| D. 318,969 | 8/1991 | Byrn . | |
| 556,088 | 3/1896 | Daly . | |
| 682,871 | 9/1901 | Hogan et al. . | |
| 2,336,707 | 12/1943 | Thompson | 5/636 |
| 3,840,916 | 10/1974 | Jennings | 5/655 |
| 3,911,512 | 10/1975 | Plate | 5/636 |
| 4,197,604 | 4/1980 | Nakamura | 5/646 |
| 4,236,264 | 12/1980 | Britzman | 5/646 |
| 4,617,691 | 10/1986 | Monti et al. | 5/636 |
| 4,731,890 | 3/1988 | Roberts . | |
| 4,790,042 | 12/1988 | Reich | 5/655 |
| 4,982,745 | 1/1991 | Shields | 5/646 |
| 5,085,214 | 2/1992 | Barrett | 5/648 |
| 5,092,005 | 3/1992 | Byrn . | |
| 5,095,567 | 3/1992 | Kenoyer | 5/655 |
| 5,109,557 | 5/1992 | Koy et al. . | |
| 5,154,649 | 10/1992 | Pender . | |
| 5,193,238 | 3/1993 | Clute . | |
| 5,216,772 | 6/1993 | Clute . | |
| 5,261,134 | 11/1993 | Matthews . | |
| 5,339,472 | 8/1994 | Yin . | |
| 5,371,909 | 12/1994 | McCarty | 5/655 |
| 5,519,906 | 5/1996 | Fanto-Chan . | |

FOREIGN PATENT DOCUMENTS

| | | | |
|---|---|---|---|
| 1076118 | 10/1954 | France | 5/636 |
| 20360 | 2/1901 | United Kingdom . | |
| 838455 | 6/1960 | United Kingdom . | |
| 2198341 | 6/1988 | United Kingdom | 5/636 |

*Primary Examiner*—Michael J. Milano

*Attorney, Agent, or Firm*—Fish & Neave; Kevin P. B. Johnson

[57] ABSTRACT

According to the invention, a support pillow has a shape and construction that makes the support pillow particularly useful in situations in which it is necessary or desirable to have a support surface near the body of a user. The support pillow can be securely attached to the body to, for example, aid in supporting a baby during feeding, provide support of the elbows, forearms and wrists while reading or using a keyboard, or provide support for the forearms or external objects while engaging in an activity such as watching television or eating. The support pillow cushions and supports the back, and helps to hold the back in an orthopedically correct position. The support pillow also relieves muscle stress associated with holding a baby or other object by enabling the baby or object to be supported by the pillow. The support pillow is shaped to conform to the user's body and can be adjusted to have a fit of desired tightness so that the pillow remains stably and securely in place on the user (even when the user is standing or moving around), the back support of the pillow is enhanced and the pillow fits comfortably on the wearer.

34 Claims, 11 Drawing Sheets

SUPPORT PILLOW WITH LUMBAR SUPPORT FOR USE IN NURSING AND OTHER APPLICATIONS

BACKGROUND OF THE INVENTION

1. Field of the Invention

This invention relates to a support pillow that can be worn around the waist to, for example, aid in supporting a baby during nursing, provide support of the forearms while typing on a keyboard, or provide support for the forearms or external objects while engaging in an activity such as reading, television watching or eating. In particular, the invention relates to such a support pillow that provides lumbar support and cushioning of the back, is adjustable to fit people of various sizes or fit a particular person with a varying degree of tightness, and attaches to a wearer so that the pillow remains securely and stably in place when the wearer moves between a sitting and standing position or walks around.

2. Related Art

Breast feeding an infant provides benefits to both the infant and the nursing mother. The mother's milk contains substances that the infant needs to develop a healthy resistance to sickness and disease, as well as a naturally balanced diet of fats and proteins that the infant needs for healthy physical development. The nursing process itself provides a time for mothers to bond with their children, thereby enhancing the emotional well-being of both the infant and the mother. Nursing also benefits the mother by stimulating the pituitary glands to release oxytocin which causes the uterus to stop bleeding and begin to contract.

Feeding a baby, whether by nursing or bottle-feeding, necessitates that the feeder support the infant, usually at a level near the waist or chest. In a typical position for holding a baby while feeding, the feeder's head is bent forward to look at the infant. The shoulders are hunched forward. The arm muscles and anterior chest muscles contract to support the infant. The specific muscles involved in this postural stress position are the trapezius, pectoralis, levator scapulae, rhomboids, deltoids, rotator cuff group (to a lesser degree), erector sinae (from the mid-back to the base of the skull), and the splenius group (in the neck). Overcontraction of these muscles puts extra stress on the spinal vertebrae to which the muscles are attached, and can lead to spinal misalignments (subluxations). Additionally, prolonged muscular contraction in this position (i.e., head forward, shoulders rounded and upper back bent forward) places extra stress on the corresponding muscle tendons which, if experienced frequently over a period of time, can lead to tendinitis, as well as to a generalized inflammation of the soft tissue called myofibrositis or myofascitis. More generally, the muscle stress arising from holding a baby during feeding often results in headache and/or muscle pain felt in the neck, shoulders, back, arms and/or wrists. Even if the muscle stress does not produce a degenerative physical condition, the physical discomfort may cause the feeder to support the baby in an awkward position that prevents the baby from feeding properly.

For several reasons, the above-described muscle stress is particularly distressing for a nursing mother. Since a mother may nurse up to 15 times per day, the mother is faced with the prospect of frequently experiencing the muscle stress associated with supporting the baby during nursing. Further, for a period of time after birth, the mother's body is recovering from the stress of the birth and can endure physical exertion to a lesser extent than would otherwise be normal. Finally, the care of a newborn infant typically leaves little time for sleep; without sleep, the mother becomes exhausted and more susceptible to muscle fatigue. These problems are exacerbated by the fact that the mother must of necessity physically exert herself many times a day to pick up and put down the baby.

Various devices, such as pillows, have been used to help alleviate the muscle stress typically experienced during feeding of a baby. A recent National Institute of Health study on breast feeding, conducted by the University of Wyoming, concluded that the use of a pillow as an aid in nursing increased the length of feeding time during nursing. A longer nursing time produces the previously described benefits of nursing to a greater degree. However, each of the previous pillows used as an aid in nursing is deficient in one or more important respects.

The prior pillows generally do not provide adequate support. For instance, while some of the prior pillows support the baby and others support the arms of the feeder, none provide adequate support of both the baby and the feeder's arms, while simultaneously supporting the feeder's back. Additionally, none of the known prior pillows cushion the back of the feeder or provide back lumbar support for the feeder. Such support characteristics are highly desirable to alleviate the muscle stress experienced by the back while supporting a baby.

Further, the existing pillows typically do not attach to the feeder's body. Thus, these pillows are usually positioned in a relatively unstable manner, requiring some balancing of the pillow by the feeder, a feat which is particularly difficult while simultaneously holding a baby (and, in the case of bottle feeding, a bottle). Additionally, none of the prior pillows remain in position if the feeder gets up from a sitting position to walk around between feedings. Consequently, the pillow must be set aside (frequently, on the floor) when the feeder stands up after feeding and picked up when the feeder sits down to feed again, thereby necessitating that the feeder engage in a lot of bending and stretching (particularly when the pillow is placed on or picked up from the floor) to transfer the pillow to and from the lap. Such exertion is an especially onerous burden for a nursing mother, even more so during the period when the mother's body is recovering from birth. Given that the mother must already engage in a lot of such bending and stretching while picking up and putting down the baby, reduction or elimination of additional such bending and stretching would be very beneficial to the mother.

Many previous pillows for support during baby feeding cannot be easily used for both right breast and left breast feeding. In order for the baby to switch feeding from one breast to another, the pillow must be repositioned (e.g., flipped over or turned around), a cumbersome task that itself induces undue muscle stress.

U.S. Pat. No. 5,261,134, issued to Matthews on Nov. 16, 1993, describes a portable pillow for support of an infant, toddler or young child in situations other than feeding. When an infant's body is placed in a well centrally formed in the pillow, the infant's head is supported by a central portion of the pillow and the feet extend out between tapered ends of the pillow. The patent does not describe wearing the pillow about the waist to support a baby during feeding. If the pillow were to be used in that way, the pillow would suffer from several disadvantages.

For example, the pillow does not completely encircle the waist of the feeder, reducing the amount of support provided by the pillow and lessening the stability and security with which the pillow attaches to the body. In particular, if worn so that the largest support area of the pillow is positioned adjacent to the stomach of the wearer, the pillow has a discontinuous, relatively insubstantial portion positioned behind the back that fails to provide back lumbar support or cushion the back. In addition, there is no mechanism for tightening the fit of the pillow about the waist; consequently, the pillow fits loosely and therefore does not provide substantial support for the wearer's back or waist. The pillow also can not be adjusted to vary the fit of the pillow about the waist. This lack of adjustability hampers the degree to which the pillow can be securely and stably positioned on the feeder, provide a custom fit for each wearer of the pillow, and provide a variable amount of support to the body of the feeder. Since the pillow does not attach securely and stably to the body, the pillow may not remain in place on the body if the feeder gets up from a sitting position to walk around between feedings. Thus, the feeder must exert unnecessary effort to set the pillow aside after feeding and pick up the pillow before feeding, resulting in undue muscle strain. The pillow also does not include an elevated portion (such as a feeding elevation wedge) to support the baby at an angle to enable the baby to feed more easily and enhance the digestive process.

U.S. Pat. No. 5,154,649, issued to Pender on Oct. 13, 1992, describes an inflatable nursing pillow having multiple air chambers which provide adjustability of air pressure and customized support for a child during bottle and breast-feeding. Though this patent shows that a removable belt can be provided to secure the pillow around a feeder's lower torso, this strap does not provide any lumbar support for the back. Further, the belt does not cushion the back when sitting against a hard surface during feeding. Additionally, the belt does not stably attach the pillow to the body. Consequently, the pillow does not remain in a support position and flops around if the feeder gets up from a sitting position to walk around between feedings. Moreover, none of the surfaces of the pillow are shaped to provide an elevated portion to support the baby at an angle to enable the baby to feed more easily and enhance the digestive process.

U.S. Pat. No. 5,092,005, issued to Byrn on Mar. 3, 1992, describes an inflatable pillow for use during feeding of a baby. The pillow described in this patent does not provide back support or cushioning. Further, there is nothing at all to hold the pillow in place when the feeder moves around, not even a flimsy belt as described in the Pender patent. Also like the Pender patent, none of the surfaces of the pillow are shaped to provide an elevated portion to support the baby at an angle to enable the baby to feed more easily and enhance the digestive process.

U.S. Pat. No. 4,731,890, issued to Roberts on Mar. 22, 1988, describes a pillow adapted for use by nursing mothers. U.S. Pat. No. 5,109,557, issued to Koy et al. on May 5, 1992, describes a pillow for use by a mother or some other person to aid in feeding an infant. The pillows described in these patents suffer from the same problems as described above for the pillow described in the Byrn patent.

Each of the prior pillows for use as an aid in feeding a baby has one or more deficiencies that make the pillow flawed when used for that purpose. A support pillow that simultaneously addresses all of the above-noted deficiencies would be a vast improvement over the existing pillows. Further, the improved support pillow would be even more useful if it had more general application and could be used for a variety of situations requiring a support surface proximal to the body of a user.

SUMMARY OF THE INVENTION

According to the invention, a support pillow has a shape and construction that make the support pillow particularly useful in situations in which it is necessary or desirable to have a support surface near the body of a user. The support pillow completely encircles the body, providing support and cushioning for the back (in particular, for the lumbar region), and holding the support pillow securely and stably to the body. In addition, the support pillow can be adjusted to accommodate people of different sizes or to enclose a particular wearer more or less tightly.

An opening is centrally formed in the support pillow so that the support pillow can be worn around the waist of the user. The opening is shaped to approximate the shape of a human waist. The support pillow has two ends which are normally adjacent to each other to define the opening so that when worn, the support pillow substantially completely surrounds the waist. The opening can be varied in size by moving the position of the ends with respect to each other. The support pillow is made of a firm, yet resilient material. Variance of the size of the opening in which the user's waist fits, the firmness and resilience of the material of which the pillow is made, and the height of the back portion of the pillow combine to enable the support pillow to fit snugly about the waist, the snug fit providing support of the user and helping to keep the support pillow in place on the user. A fastening mechanism can be attached to the ends of the support pillow and used to make the support pillow fit even more snugly about the waist so that the pillow is held more securely and stably to the body. The support pillow is made of a lightweight material so that the support pillow can be easily lifted by the user. In one embodiment, the support pillow is made of a material that is sufficiently light to allow the user to easily pick up the pillow with one arm, such as may be necessary when the other arm is being used to hold a baby. Since the pillow is light, the pillow also does not become too heavy when the user uses the pillow for an extended period of time.

The front portion of the support pillow is sized and constructed to enable support of a variety of objects such as a baby, a book, a plate, or simply the forearms and hands of the user. The side portions of the support pillow are sized and constructed to support the elbows and forearms of the user in a natural position. The back portion of the support pillow is sized and constructed to provide support for the user's back muscles and cushioning for the user's back, as well as to ensure that the user sits or stands in a more posturally correct position than would be the case if the back portion was not present.

In one embodiment according to the invention, a support pillow to be worn around the waist of a user is made of a resilient material formed in a substantially toroidal shape to define an opening through which the user's waist fits. The toroidal shape includes a front portion, first and second side portions and a back portion. The front portion has a first end that is adjacent to a first end of the first side portion and a second end that is adjacent to a first end of the second side portion. The back portion has a first end that is adjacent to the second end of the first side portion and a second end that is adjacent to the second end of the second side portion. The front portion has a width of sufficient magnitude to enable support of an object on the front portion. Each of the first and second side portions have a width of sufficient magnitude to provide support for an elbow and forearm of the user. The back portion has a width and height having sufficient magnitude to cushion the user's back when pressed against a hard surface.

In another embodiment according to the invention, a support pillow to be worn around the waist of a user includes: i) a resilient material formed in a substantially toroidal shape to define an opening through which the user's waist fits, the toroidal shape being broken to form first and second ends that are separated from each other; and ii) a mechanism for attaching the first end to the second end. The pillow is shaped such that, when the pillow is in an unstressed condition, the first and second ends are naturally biased toward a closed position in which the first and second ends are adjacent to each other.

In still another embodiment according to the invention, a support pillow to be worn around the waist of a user to aid in feeding a baby is formed in a substantially toroidal shape to define an opening through which the user's waist fits, the opening having a contour that approximates the shape of a human waist. The pillow includes a support surface on which the baby is supported.

In yet another embodiment according to the invention, a support pillow to be worn around the waist of a user to aid in feeding a baby includes: i) a support surface on which the baby is supported, the support surface being substantially flat; ii) a lap surface opposite the support surface, the lap surface adapted to fit comfortably against the lap of the user; and iii) a feeding elevation wedge formed on the support surface to enable the baby to be supported in a feeding position.

In still another embodiment according to the invention, a support pillow to be worn around the waist of a user is made of a resilient material formed in a substantially toroidal shape to define an opening through which the user's waist fits, the size of the opening being adjustable to accommodate the particular waist size and shape of the user. The toroidal shape of the pillow is broken to form first and second ends that are separated from each other. The pillow is shaped such that, when the pillow is in an unstressed condition, the first and second ends are naturally biased toward a closed position in which the first and second ends are adjacent to each other. The pillow is made sufficiently flexible to allow the first and second ends to be moved away from each other to a wearing position, the position of the first and second ends in the wearing position being determined by the size and shape of the user's waist.

While the support pillow according to the invention can be used for a variety of purposes, the support pillow is particularly useful as an aid in supporting a baby during feeding. The support pillow simultaneously provides support for a baby and for the elbows, arms and hands of the feeder, easing the burden of holding the baby during feeding and freeing one or both arms for caressing the baby during feeding. The support pillow supports the baby at a height near the nipple of the feeder so that the baby can nurse without undue exertion and so that the feeder can feed the baby without hunching over and stressing the neck and back muscles. Since the pillow supports the baby, stress on arm, chest and back muscles is also reduced. The support pillow also provides support for the lumbar region of the feeder's back, cushions the back, and helps to position the feeder with proper posture, thereby reducing stress on the back. The support pillow according to the invention is the first pillow for use as an aid in feeding a baby that provides such back support and cushioning. Since a baby must be fed several times each day, these support characteristics are particularly beneficial in avoiding or minimizing repetitive stress injuries to soft tissue and/or joints, known as "repetitive use syndrome" or "postural stress syndrome." Further, since the support pillow according to the invention provides comfort to the feeder and eases the feeder's muscle strain, the feeder will likely feed the baby for a longer period of time than would be the case if one of the prior art pillows described above was used. As discussed above, this provides benefits to both the feeder and the baby, particularly in the case of nursing.

As a nursing pillow, the support pillow according to the invention is unique in that it combines a large number of features that previously have not all been present in a nursing pillow. Perhaps most importantly, as noted above, the support pillow according to the invention provides a back support portion that provides lumbar support for the back, cushions the back, and helps to position the mother's in an anatomically correct posture for nursing, thereby reducing the muscle fatigue that a mother typically experiences when leaning over to cradle and feed an infant. The beneficial back support characteristics arise from the thickness and height of the back support portion, the firm yet resilient material of which the pillow is made and the adjustability of the pillow (discussed in more detail below) which enables the back support portion to be "firmed up" around the waist and lower back.

Additionally, the support pillow completely encircles the waist of the feeder. The complete encirclement of the pillow about the waist, the robustness of the back support portion, and the adjustability of the fit of the pillow all contribute to the stability of the pillow on the feeder's body, thereby ensuring that the baby is supported safely during feeding. These features of the pillow also give the feeder a feeling of security, in addition to providing the actual physical support discussed above. Such stability is not afforded by, for instance, the pillow described in the Pender patent which includes a relatively flimsy belt to attach the pillow to the body.

Additionally, as a consequence of the fact that the support pillow completely surrounds the feeder, and proper sizing of the side support surfaces, the support pillow provides support for the feeder's elbows and forearms during feeding. Support of the feeder's elbows and forearms also helps to reduce muscle stress associated with feeding the baby, in particular stress of the trapezius muscles. This support is particularly useful for bottle-feeders to help support the extended arm that holds the bottle. The front portion of the pillow is also sized so that the baby is supported at the proper height for feeding. The support pillow according to the invention is the first support pillow to integrate these two support characteristics (baby support and feeder arm support).

Further, the front support surface extends fully across the front of the feeder, providing support for the infant no matter which breast the infant is feeding from during nursing or which arm the infant is being cradled with during bottle-feeding, thereby allowing the feeder to switch breasts during nursing or the cradling arm during bottle-feeding. In addition, a surface of the support pillow is specially contoured to form one or more feeding elevation wedges that support the baby in the proper position during feeding. One wedge is formed at each end of the front portion of the pillow so that the baby is supported at the proper angle when feeding from either breast or cradled with either arm. The wedges are positioned so as to allow the baby to comfortably lie in either a supine position (such as may occur when the baby is resting) or a side position (such as occurs when the baby is feeding).

The contour of the opening of the support pillow according to the invention conforms approximately to the shape of the human waist. The size of the opening can be varied in size, either to accommodate different waist sizes or to fit the pillow more or less tightly about the waist of a particular wearer. The support pillow is formed with a discontinuity at one side, so that one side portion of the pillow includes two ends that are adjacent to each other. The back portion of the support pillow cantilevers about a pivot point at the opposite side of the support pillow, thereby enabling the ends to be moved closer to or farther from each other. As mentioned above, the support pillow is also formed of a firm yet resilient material which, in combination with the adjustable back portion, enables the pillow to be adjusted to provide a relatively tight fit that holds the pillow securely and stably in place on the wearer and enhances the lumbar support of the pillow. Thus, the pillow is held in place during feeding with little effort from the feeder and the feeder can stand and walk around between feedings without removing the support pillow, eliminating the need to bend and stretch to set the pillow down after feeding or pick the pillow up prior to feeding. In fact, the pillow is held so securely on the body that, while standing, the user can rest his arms or an object on the pillow without causing the pillow to fall from the body. This feature is particularly useful in minimizing muscle strain for mothers who gave birth by Cesarean-section. The adjustability of the support pillow according to the invention allows the feeder to adjust the fit of the pillow for maximum comfort and stability. Thus, as a mother experiences a post-partum reduction in waist size, the mother can adjust the size of the opening accordingly. This adjustability is also particularly important to mothers who are recovering from a Cesarean-section delivery, the adjustability enabling these mothers to wear the pillow relatively loosely so that the wounds from surgery are not aggravated. The softness of the material with which the pillow is made also helps in this regard. Further, since the discontinuity in the pillow is formed on the side, the support pillow according to the invention is adjustable without sacrificing any of the back support characteristics of the pillow. Finally, the support pillow can include an adjustment strap which can be used to further adjust the fit of the pillow.

Lightweight materials are used to construct the support pillow according to the invention. In one embodiment, the pillow is made of a material that is light enough to enable the pillow to be picked up using one arm. The pillow also does not become uncomfortably heavy when held in the lap during a prolonged feeding. Additionally, the pillow is light enough to wear while walking or standing. In a particular embodiment, the support pillow includes a washable cover and a cushion, the washable cover being easily removable to effect cleaning. The support pillow can also include pockets that are attached in a readily accessible location on the pillow. The pockets enable objects such as a bottle or cordless telephone to be retained in proximity to the feeder while feeding the baby.

The support pillow according to the invention can be used for many purposes and in many situations other than feeding a baby. For example, the support pillow can be used as an aid in accomplishing any task which requires working with the hands in proximity to the lap, such as sewing, typing on a keyboard, or reading or writing. For use in these situations, the support pillow is worn about the waist in the same manner as described above.

The support pillow according to the invention can also be used to provide support and improve posture while sitting. For example, the support pillow can be worn while watching television, flying in an airplane, or riding in a car. The support pillow is useful when sitting in a chair, on a stool or on the floor. The support pillow can also be used to provide support while in a reclining position on, for example, a bed, a couch or a floor.

DETAILED DESCRIPTION OF EMBODIMENTS OF THE INVENTION

Figure 1A:
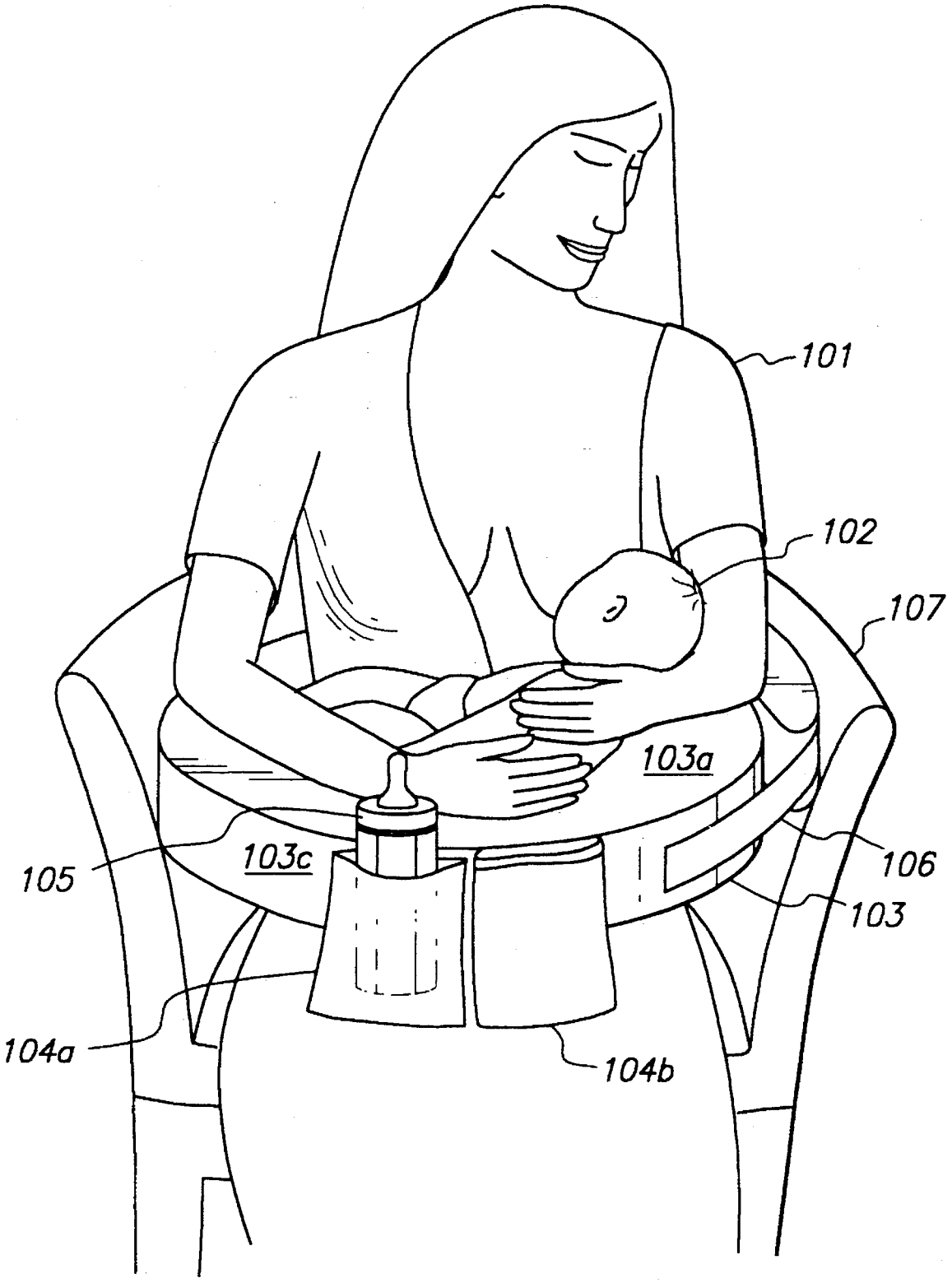
FIGS. 1A and 1B are front and side perspective views, respectively, of a woman nursing a baby, illustrating use of a support pillow according to the invention.
Figure 1B:
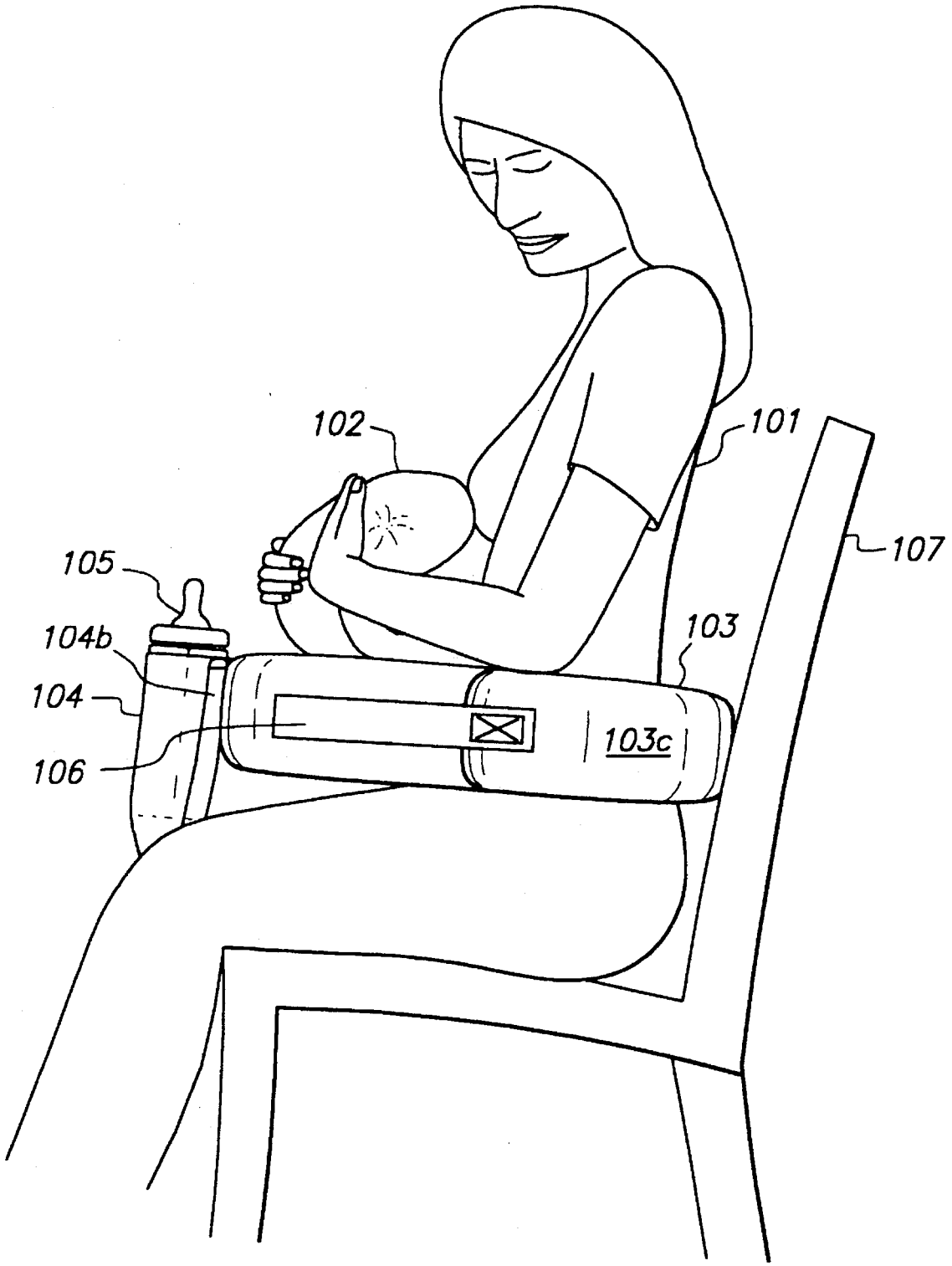
Figure 2A:
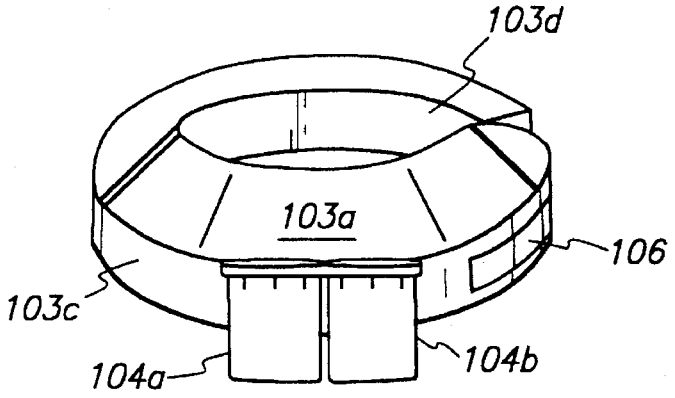
FIGS. 2A, 2B and 2C are a perspective view, top view and side view, respectively, of the support pillow of FIGS. 1A and 1B.
Figure 2B:
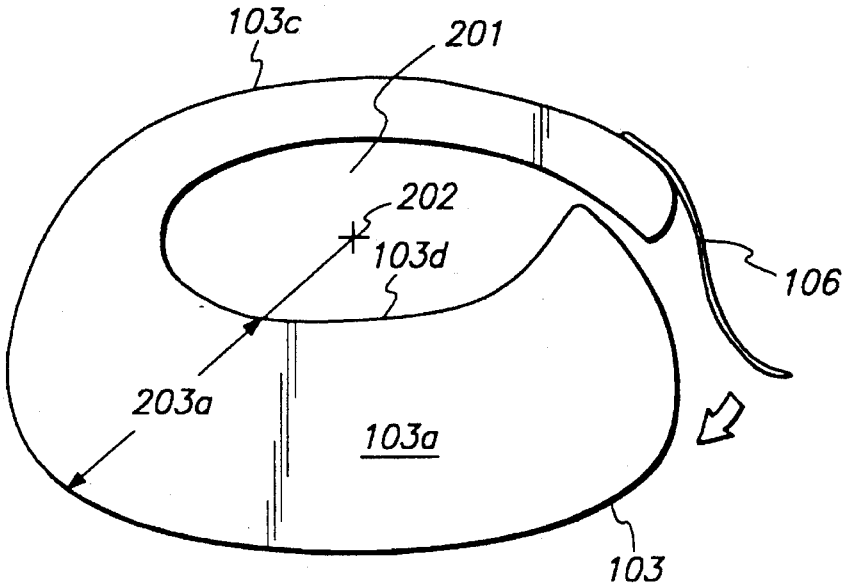
Figure 2C:
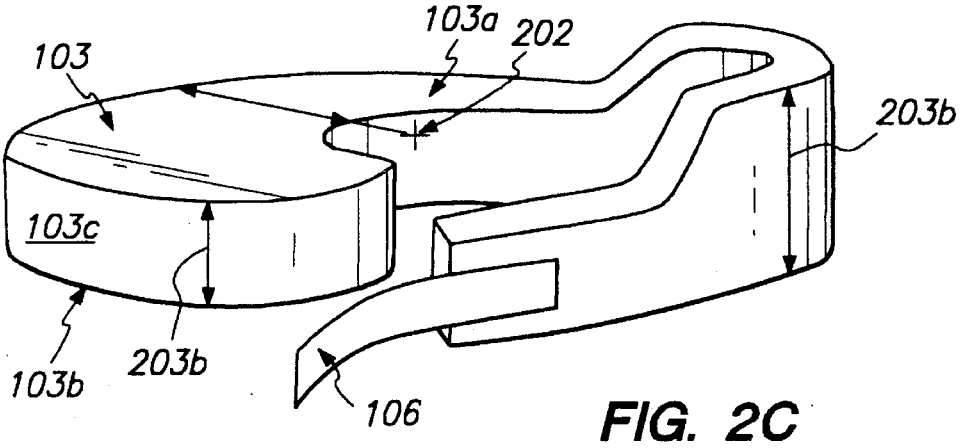

FIGS. 1A and 1B are front and side perspective views, respectively, of a woman 101 nursing a baby 102, illustrating use of a support pillow 103 according to an embodiment of the invention. FIGS. 2A, 2B and 2C are a perspective view, top view and side view, respectively, of the pillow 103. Since none of FIGS. 1A, 1B, 2A, 2B and 2C show a precise representation of the support pillow 103, there are slight differences in the shape of the support pillow 103 between figures; however, each of these figures represent the essential features of the support pillow 103.

The pillow 103 has a substantially toroidal shape so that an opening 201 (FIGS. 2A and 2B) is defined in the center of the pillow 103. While the shape of the pillow 103 is substantially toroidal, it is not precisely toroidal: in successive cross-sections taken in a circumferential direction, the pillow 103 does not have a constant cross-sectional shape or cross-sectional area. Nor is the centroid of each cross-section the same distance from the axis 202 of rotation of the toroidal shape as the centroid of other cross-sections. Further, the continuity of the toroidal shape is broken at one location so that the pillow 103 is formed as a structure having two ends, one end being proximal to the other end to define the opening 201.

To aid in the description of the pillow 103, reference is made herein to the "front portion," "side portions," and the "back portion" of the pillow 103. Herein, when the pillow 103 is worn with proper orientation about the waist (i.e., as shown in FIGS. 1A and 1B), "front portion" refers to that portion of the pillow 103 which is adjacent to the stomach of the wearer, "side portion" refers to a portion of the pillow that is adjacent to a side of the waist of the wearer, and "back portion" refers to that portion of the pillow 103 that is adjacent to the lower back of the wearer. However, it is to be understood that these portions are not sharply delineated in the pillow 103.

In the embodiment of the invention shown in FIGS. 1A, 1B, 2A, 2B and 2C, the pillow 103 is formed with opposing substantially flat surfaces 103*a* (FIGS. 1A, 2A, 2B and 2C) and 103*b* (FIG. 2C) that are substantially perpendicular to the axis 202 (FIGS. 2A and 2B). The flat surfaces 103*a* and 103*b* are connected by each of two substantially flat surfaces 103*c* (FIGS. 1A, 1B, 2A, 2B and 2C) and 103*d* (FIGS. 2A and 2B) that are substantially perpendicular to the flat surfaces 103*a* and 103*b*. The surfaces 103*a* and 103*b* are designated as the "support surface" and the "lap surface," respectively. The surfaces 103*c* and 103*d* are designated as the "outer contour" and the "inner contour," respectively. As best shown in FIG. 1B, each of the intersections ("corners") between one of the inner contour 103*d* or outer contour 103*c* and one of the support surface 103*a* or lap surface 103*b* are rounded. Thus, as with the front, side and back portions of the pillow 103, the inner contour 103*d* and outer contour 103*c* are not sharply delineated from the adjoining support surface 103*a* or lap surface 103*b*. Moreover, in other embodiments of the invention, the rounding of the corners is so great that the inner and outer contours of the pillow are completely rounded and do not have a flat portion.

The lap surface 103*b* enables the pillow 103 to rest comfortably and stably in the lap when the pillow 103 is worn while sitting. Since the lap surface 103*b* is flat, contact with the lap does not force the pillow 103 into an awkward position nor cause the pillow 103 to rock when the pillow 103 is worn while sitting. Further, the flat lap surface 103*b* fits against the lap without producing uncomfortable pressure on any part of the legs.

The support surface 103*a* provides comfortable and stable support for both the person wearing the pillow 103 and/or any objects being held by that person. For example, as shown in FIGS. 1A and 1B, while nursing, the woman 101 can support the baby 102 on the front portion of the pillow 103. The pillow 103 is made of a resilient material, as described in more detail below, so that the baby and/or the arms of the person wearing the pillow 103 are cushioned. At the same time, the material is sufficiently firm so that the baby and/or the arms are held in a stable position during nursing.

As seen in FIGS. 1A and 1B, the pillow 103 fits around the waist of the woman 101. Since the pillow 103 fits snugly around the entire waist of the woman 101, the pillow 103 provides support and comfort at all points on the waist. In particular, the pillow 103 cushions the woman's lower back against the chair 107.

As described above, in the typical baby-holding position, the feeder's head is bent forward to look at the infant, the shoulders are hunched forward, and the arm muscles and anterior chest muscles are contracted to support the infant. Excessive or prolonged contraction of these muscles can cause pain, spinal deformity or muscular deterioration. The pillow 103 provides support which alleviates the muscle stress associated with this typical baby-holding position. Since the baby 102 is supported at a level near the breasts of the woman 101, it is not necessary for the woman 101 to hunch over when feeding the baby 102. Further, since the pillow 103 supports the baby 102, muscle stress in the arms, shoulders and back is reduced.

Though the support pillow according to the invention is described above as used in nursing, the support characteristics provided are useful for other activities as well, such as reading, knitting and desk work in a chair that has no arm rests.

The pillow 103 is not confined to any specific set of dimensions. In practice, support pillows according to the invention can have a number of different sizes. The particular size of the pillow can vary with the use for which the pillow is intended as well as the size of the people for whom the pillow is intended. In view of the above, the dimensions of the support pillow according to the invention are described below primarily as they relate to the functional attributes of the pillow; the use of specific dimensions is intended merely to be illustrative and not as a limitation of the size or proportions of the pillow.

As seen in FIGS. 2B and 2C, the support pillow 103 has a width 203*a* and a height 203*b*. The width 203*a* at each cross-section through the pillow 103 is defined as the greatest distance between points on the inner and outer contours 103*d* and 103*c* along a line extending through the axis 202 and parallel to the support and lap surfaces 103*a* and 103*b*. The height 203*b* at each cross-section is defined as the distance between the support surface 103*a* and the lap surface 103*b*.

In one embodiment, the height 203*b* of the front portion is established so that, when the pillow 103 is used to support a baby during feeding, the baby 102 is supported at a height that enables the baby 102 to nurse comfortably without need for the woman 101 to lift the baby 102 toward the breast. In this embodiment, the width 203*a* of the front portion is specified so that there is ample room to rest the baby safely on the pillow 103. It is also desirable to allow sufficient room for the person feeding the baby to rest their forearms on the pillow 103 to cradle the baby. In another embodiment, the height 203*b* of the front portion is established so that a person's hands and forearms rest comfortably on the pillow 103 while supporting a book that is supported on the pillow 103, eating from a plate that is supported on the pillow 103, or using the support surface 103*a* as a work surface. In this embodiment, the width 203*a* of the front portion of the pillow 103 is made large enough to accommodate support of both the book, plate or other object, and the forearms and hands of the wearer of the pillow. In another embodiment, the height 203*b* of the front portion is established so that a person's hands and wrists rest at a comfortable height while typing on a keyboard that is adjacent to the pillow 103. In this embodiment, the width 203*a* of the front portion of the pillow 103 is made large enough to support both the forearms and wrists when extended toward the keyboard.

Illustratively, the height 203*b* of the front portion of the pillow 103 is typically within a range of 2 to 6 inches. Usually the height 203*b* remains constant for the entire front portion, though this need not necessarily be the case. The width 203*a* of the front portion of the pillow 103, on the other hand, typically varies, usually being smallest at the middle of the front portion and gradually increasing in either direction moving toward the side portions. Illustratively, the width 203*a* at the middle of the front portion is typically within a range of 7–12 inches and the width 203*a* at either end of the front portion adjacent to a side portion is typically within a range of 8–12 inches.

The height 203*b* of the side portions of the pillow 103 are chosen so that the elbows and forearms of the wearer of the pillow 103, when held naturally at the sides of the body during feeding of a baby, reading a book, eating or working on a keyboard, are supported on the pillow 103 without necessity for awkward positioning. The height 203*b* of the side portions typically remains constant. The width 203*a* of the side portions is chosen to provide adequate surface area to support the elbows and forearms. The width 203*a* of the side portions typically varies, being widest near the front portion and gradually decreasing moving toward the back portion. Illustratively, the height 203*b* of the side portions is within a range of 4–7 inches and the width 203*a* at the position at which the elbows rest is within a range of 3–6 inches.

The height 203*b* of the back portion of the pillow 103 is specified so that the back portion provides support that reduces muscle stress in the back, provides adequate area for cushioning the back against the back of a chair, and causes the wearer of the pillow 103 to sit in an orthopedically correct manner. The width 203*a* of the back portion is also chosen to provide adequate support, cushioning and positioning of the back. Typically, the height 203*b* and width 203*a* of the back portion vary, though either can be constant. For example, to provide greater back support, the middle section of the back portion can be made with a greater height than the end sections of the back portion. Further, to enhance back support, the height 203*b* of the back portion can be made greater than the height 203*b* of the front portion. Illustratively, the height 203*b* of the middle section of the back portion is within a range of 3–8 inches, the height 203*b* of the end sections of the back portion are within a range of 3–6 inches, and the width 203*a* is within a range of 2–4 inches.

In the embodiment shown in FIGS. 1A and 1B, an adjustment strap 106 is used to attach the ends of the pillow 103 to each other. The adjustment strap 106 helps to ensure that the pillow 103 remains in position about the waist. However, in other embodiments of the invention, the adjustment strap 106 is not present. The pillow 103 is made, as described in more detail below, in a fashion that enables the pillow 103 to remain in position about the waist, under many circumstances, even without the adjustment strap 106.

In the embodiment shown in FIGS. 1A and 1B, pockets 104*a* and 104*b* are formed on the pillow 103. The pockets 104*a* and 104*b* can be used to hold any of a number of items. For instance, in FIGS. 1A and 1B, a baby bottle 105 is shown inserted into the pocket 104*a*. The pockets 104*a* and 104*b* can be used to hold other items such as a cordless telephone, towel, small toy or a book. As will be apparent from the description below, a support pillow according to the invention can be used for many purposes other than to aid in nursing a baby; in these applications, pockets formed on the support pillow can hold many other types of objects such as, for example, a book, eyeglasses, pencils, a calculator, or a cordless telephone (see, e.g., FIG. 9B).

In FIGS. 1A and 1B, the pockets 104*a* and 104*b* are attached to the outer contour 103*c* of the pillow 103. However, this need not be the case, and the pockets 104*a* and 104*b* can be attached to the pillow 103 on another surface, e.g., support surface 103*a*. The pockets 104*a* and 104*b* can be attached to the pillow 103 in any desired manner. For example, the pockets 104*a* and 104*b* can be sewn on to the pillow 103, or attached using hook and loop Velcro™ strips.

As explained in more detail below, the pillow 103 can be worn with either the support surface 103*a* or the lap surface 103*b* facing upward. According to one embodiment of the invention, the pockets 104*a* and 104*b* each have two pouches, one on each side of the pocket 104*a* or 104*b*. As a result, in this embodiment, the pockets 104*a* and 104*b* can be used to hold an object regardless of whether the support surface 103*a* or the lap surface 103*b* is facing upward, thereby enhancing the versatility of the pillow 103.

A support pillow according to the invention need not necessarily have pockets such as pockets 104*a* and 104*b*, and, in other embodiments of the invention, pockets are not present. In FIGS. 2B and 2C, the support pillow 103 is shown without pockets 104*a* and 104*b*.

Figure 3A:
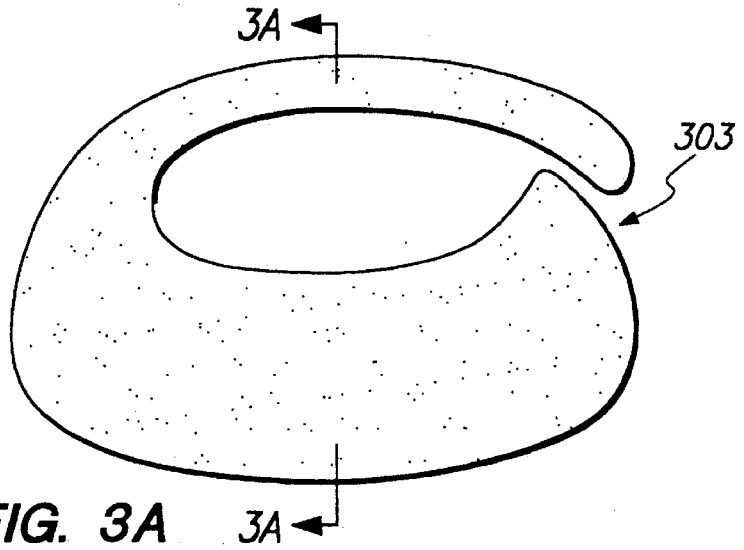
FIG. 3A is a top view of a support pillow according to an embodiment of the invention.
Figure 3B:
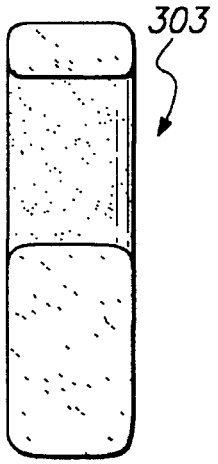
FIG. 3B is a cross-sectional view of the support pillow of FIG. 3A, taken along sectional line 3A—3A of FIG. 3A.

FIG. 3A is a top view of a support pillow 303 according to an embodiment of the invention. FIG. 3B is a cross-sectional view of the support pillow 303, taken along sectional line 3A—3A of FIG. 3A. The pillow 303 is made of a material that is soft enough to provide comfortable support of a baby and a person's elbows, forearms and hands, and soft enough to provide a comfortable cushion for the back when sitting in a chair. The material must also be sufficiently firm so that the pillow 303 provides the necessary support and does not collapse when subjected to reasonable loads (e.g., a baby's weight). In one embodiment, the pillow 303 is made of foam. In a particular embodiment, the pillow 303 is made of a 16 ounce polyurethane-ether foam. In a further particular embodiment, the foam has a 30/36 ILD firmness rating and a 2.0 density rating. However, the pillow 303 can be made of any other foam such as a closed-cell foam. The foam is molded into the desired shape of the pillow 303 using conventional equipment and processes.

Figure 4A:
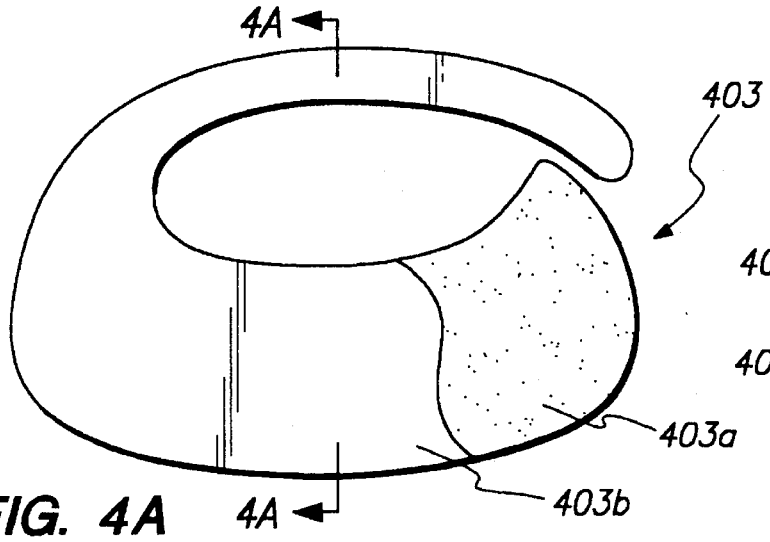
FIG. 4A is a top view of a support pillow according to an embodiment of the invention
Figure 4B:
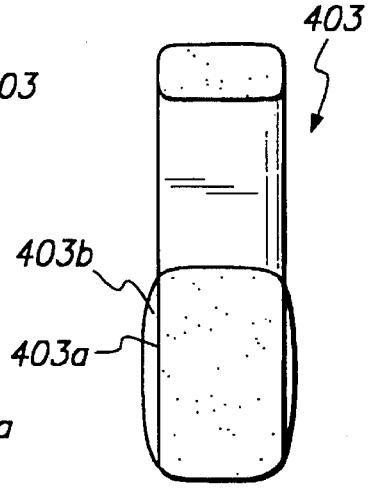
FIG. 4B is a cross-sectional view of the support pillow of FIG. 4A, taken along sectional line 4A—4A of FIG. 4A.

FIG. 4A is a top view of a support pillow 403 according to an embodiment of the invention. FIG. 4B is a cross-sectional view of the support pillow 403, taken along sectional line 4A—4A of FIG. 4A. The pillow 403 has the same overall shape and dimensions as the pillow 303. However, the pillow 403 is constructed differently than the pillow 303.

The pillow 403*a* includes a cushion 403*a* and a cover 403*b*. The cushion 403*a* is made of a material having the same general properties as described above for the material used for the pillow 303 (FIGS. 3A and 3B). The cushion 403*a* can be made of, for instance, foam. The cover 403*b* is made of a material that feels comfortable against the skin, can be easily washed, can be easily removed from and placed over the cushion 403*a*, and is not unsafe for contact with the skin or when in proximity to humans. In one embodiment, the cover 403*b* is made of cotton, e.g., flannel. The cover 403*b* must be constructed so that the cover 403*b* can be removed from the cushion 403*a*. In one embodiment, the cover 403*b* includes a zipper for this purpose. Construction of a pillow according to the invention, e.g., the pillow 403, with a cover over a cushion makes it easier to keep the pillow clean, since the cover, which collects most of the dirt, can be removed and washed.

Figure 5A:
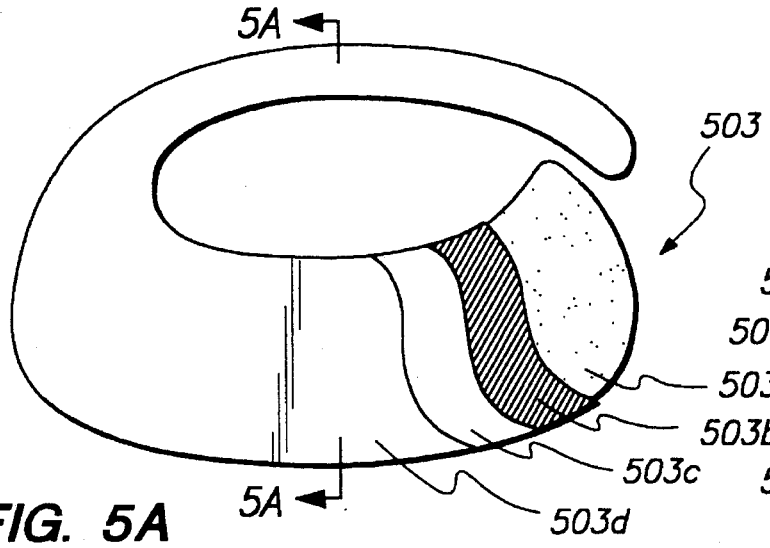
FIG. 5A is a top view of a support pillow according to an embodiment of the invention
Figure 5B:
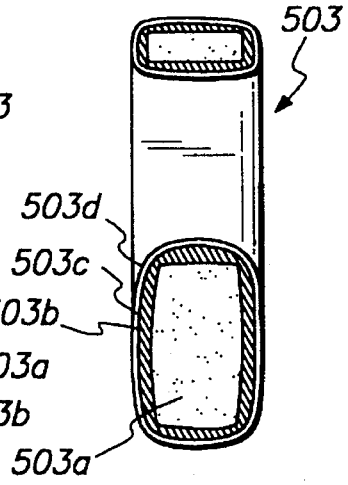
FIG. 5B is a cross-sectional view of the support pillow of FIG. 5A, taken along sectional line 5A—5A of FIG. 5A.

FIG. 5A is a top view of a support pillow 503 according to an embodiment of the invention. FIG. 5B is a cross-sectional view of the support pillow 503, taken along sectional line 5A—5A of FIG. 5A. The pillow 503 has the same overall shape and dimensions as the pillows 303 and 403. However, the pillow 503 is constructed differently than either the pillow 303 or the pillow 403.

The pillow 503*a* includes a cushion 503*a*, some batting 503*b*, an inner cover 503*c* and an outer cover 503*d*. The cushion 503*a* is made of a material having the same general properties as described above for the pillow 303 (FIGS. 3A and 3B) and can be, for instance, a foam. The batting 503*b* is formed over the cushion 503*a*. The batting 503*b* adds resiliency and firmness to the cushion 503*a* and may also improve the aesthetic appearance of the cushion 503*a*. In one embodiment, the batting 503*b* is made of polyester. The batting 503*b* is formed on the cushion 503*a* by spraying an adhesive such as Elmer's Spray Adhesive on the cushion 503*a*, then attaching the batting 503*b* to the adhesive. In the embodiment shown in FIG. 5B, the batting 503*b* covers the entire cushion 503*a*. In another embodiment, the batting 503*b* covers all but the inner surface (i.e., the surface that is proximal to the waist when the pillow 503 is worn by a user) of the pillow 503*a*. The inside cover 503*c* fits over the batting 503*b* and the outside cover 503*d* fits over the inside cover 503*c*. The outside cover 503*d* is made of a material, such as flannel, that meets the criteria described above with respect to the cover 403*b* (FIGS. 4A and 4B). The inside cover 503*c* is made of a material that minimizes friction between the inside cover 503*c* and the outer cover 503*d* when those two are moved with respect to each other, so that the outside cover 503*d* can be easily removed from the pillow 503. The inside cover 503*c* also helps to hold the batting 503*b* in place and is not removable from the pillow 503. In one embodiment, the inside cover 503*c* is made of satin.

In another embodiment of the invention, the pillow 503 includes a resilient filler rather than a cushion 503*a*. The filler can be made of, for instance, polyester or cotton.

In yet another embodiment of the invention, the batting 503*b* is eliminated and the pillow 503 includes only the cushion 503*a*, the inner cover 503*c* and the outer cover 503*d*.

Particular materials have been described above for use in construction of various embodiments of the support pillow according to the invention. Whichever materials are used, the materials are preferably non-allergenic.

Additionally, for each of the embodiments of the support pillow according to the invention described above, pockets (as shown in FIGS. 1A and 1B) can be attached to the support pillow.

Figure 6A:
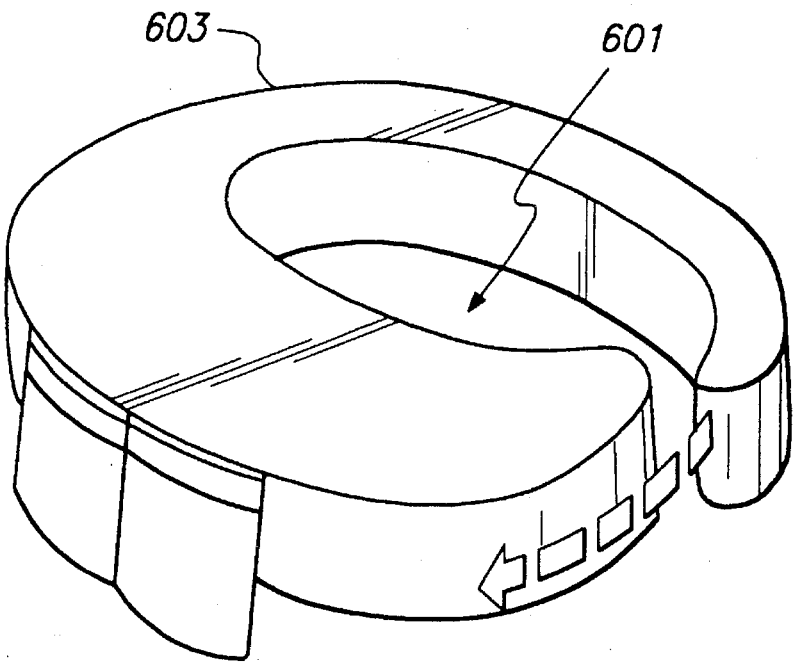
FIG. 6A is a perspective view of a support pillow according to the invention illustrating generally the attachment of two ends of the support pillow to form an enclosed opening.

FIG. 6A is a perspective view of a support pillow 603 according to the invention illustrating, in a general manner, the movement of the two ends of the support pillow 603 to form a substantially fully enclosed opening 601 through which a user's waist fits. The support pillow 603 is made with a shape so that the ends of the support pillow 603 are proximal to, but usually spaced apart from, each other. In the embodiments shown herein, the side portion opposite the pillow ends is made with a small width relative to the width of the front portion. The support pillow 603 is also made of a flexible material. Thus, the pillow 603 can be cantilevered about the side portion so that the back portion moves with respect to the front portion to enable the ends of the support pillow 603 to be moved into contact with each other. Further, in the embodiment shown in FIG. 6A, the pillow 603 is shaped so that, when the ends are moved against each other, one of the ends slightly overlaps the other end. As a result of the above characteristics, the back and front portions of the pillow 603 can be variably positioned with respect to each other so that the opening in the pillow 603 can vary in size, enabling the pillow 603 to fit snugly around people having a range of waist sizes.

Figure 6B:
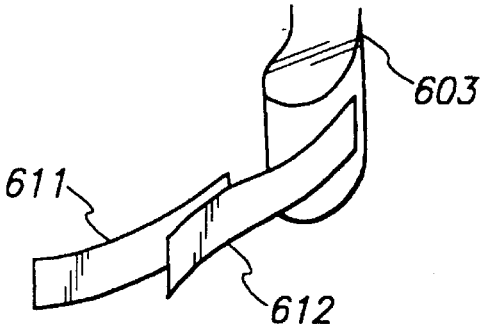
FIG. 6B is a perspective view of a portion of the support pillow of FIG. 6A illustrating a mechanism, according to an embodiment of the invention, for attaching the two ends of the pillow.

FIG. 6B is a perspective view of a portion of the support pillow 603 illustrating a mechanism, according to an embodiment of the invention, for attaching the two ends of the pillow 603. A first Velcro™ strip 611 is attached to one end of the pillow 603. A second Velcro™ strip 612 is attached to the other end of the pillow 603. The strips 611 and 612 can be attached to the respective ends by using an adhesive or by sewing the strip 611 or 612 to the end. The strips 611 and 612 form a hook and loop Velcro™ strip combination so that when the strips 611 and 612 are contacted with each other, the two ends of the pillow 603 are attached to each other.

Figure 6C:
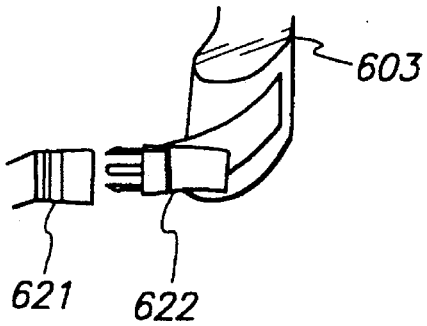
FIG. 6C is a perspective view of a portion of the support pillow of PIG. 6A illustrating a mechanism, according to another embodiment of the invention, for attaching the two ends of the pillow.

FIG. 6C is a perspective view of a portion of the support pillow 603 illustrating a mechanism, according to another embodiment of the invention, for attaching the two ends of the pillow 603. A first strap 621 is attached to one end of the pillow 603 and a second strap 622 is attached to the other end. The straps 621 and 622 can be attached to the respective ends by using an adhesive or by sewing. A retention member including a pair of compressible arms are formed at the end of the strap 622. An outwardly facing catch is formed on the each of the arms. A slotted member is formed at the end of the strap 621. The arms of the retention member at the end of the strap 622 are compressed, inserted into the slotted member at the end of the strap 621, and then released so that the catches on the arms contact surfaces of the slotted member to retain the retention member in the slotted member, thereby attaching the two ends of the pillow 603.

Figure 6D:
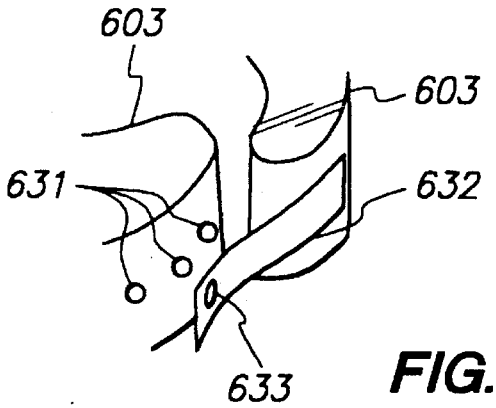
FIG. 6D is a perspective view of a portion of the support pillow of FIG. 6A illustrating a mechanism, according to yet another embodiment of the invention, for attaching the two ends of the pillow.
Figure 7D:
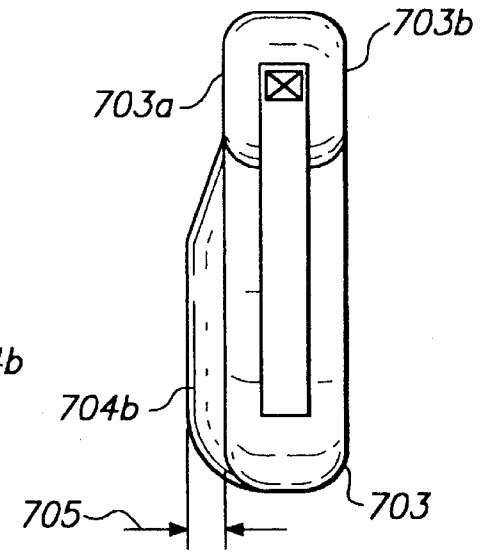
FIGS. 7A, 7B, 7C and 7D are a top view, front view, first side view and second side view, respectively, of a support pillow according to another embodiment of the invention.
Figure 7A:
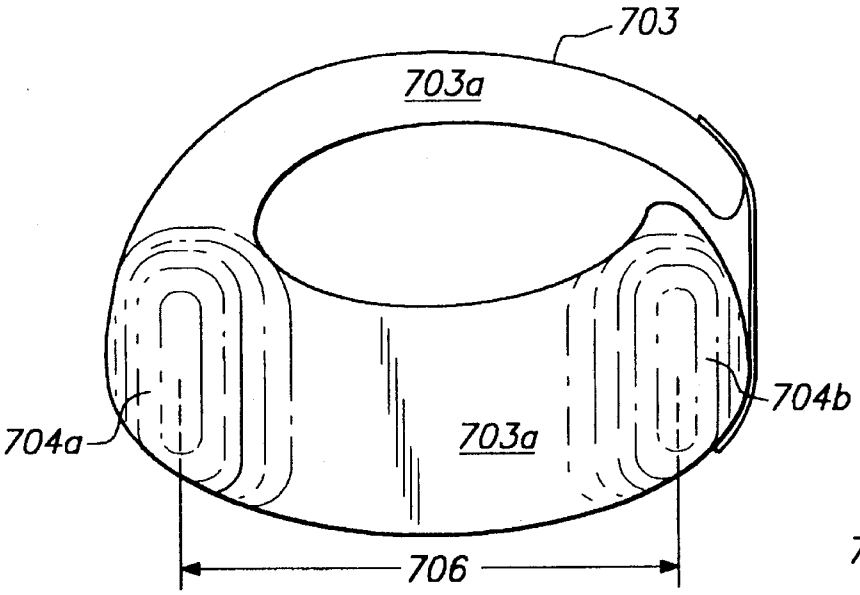
Figure 7B:
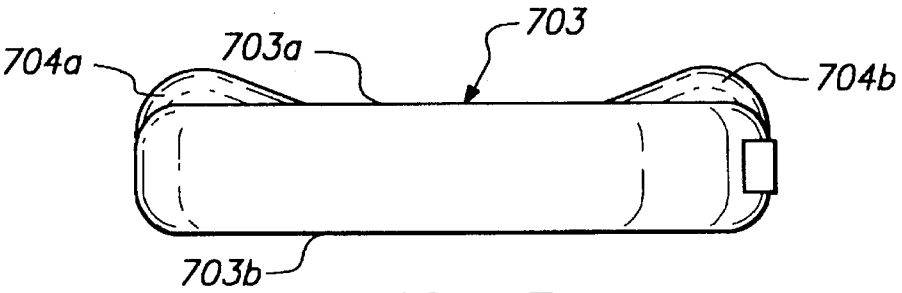
Figure 7C:
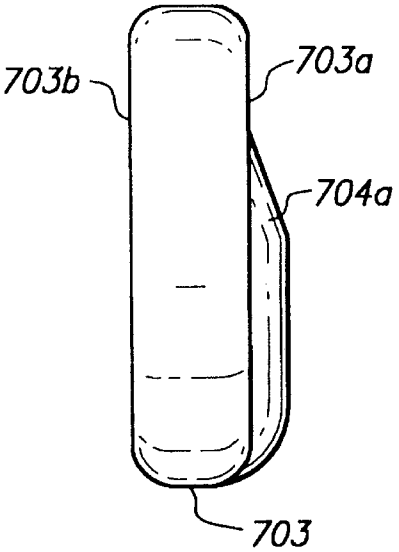

FIG. 6D is a perspective view of a portion of the support pillow 603 illustrating a mechanism, according to yet another embodiment of the invention, for attaching the two ends of the pillow 603. A strap 632 is attached (by, for instance, sewing or using an adhesive) to one end of the pillow 603. One member 633 of a snap assembly (either the male or female member) is attached to the strap 632. The other member 631 of the snap assembly is attached to the other end of the pillow 603 by compression fitting a retention portion of the member 631 into the pillow 603. The two members 631 and 633 are snapped together to attach the two ends of the pillow 603 together. In another embodiment, a slot is formed in the strap 632 and a button is attached to the other end of the pillow 603, the button being inserted into the slot to attach the two ends of the pillow 603 together.

The above mechanisms are merely illustrative of the possibilities for attaching the two ends of the pillow 603. Many other mechanisms could be used and are within the scope of the invention.

The support pillow according to the invention is structured to achieve a high degree of versatility. For example, the support pillow can be worn so that either of two opposing substantially flat surfaces face upward. For example, the support pillow 103 (FIGS. 1A, 1B, 2A, 2B and 2C) can be worn with the support surface 103*a* facing upward, as shown in FIGS. 1A and 1B, or the support pillow 103 can be flipped over and worn so that the lap surface 103*b* faces upward. In fact, for a support pillow according to the invention that is symmetric with respect to a plane that is perpendicular to the axis of rotation of the toroidal shape (i.e., axis 202 shown in FIGS. 2B and 2C), such as the support pillow 103, designation of the surfaces 103*a* and 103*b* as the support surface or lap surface is arbitrary. Either of the surfaces 103*a* or 103*b* can be identified with either designation and perform the function associated with that designation.

FIGS. 7A, 7B, 7C and 7D are a top view, front view, first side view and second side view, respectively, of a support pillow 703 according to another embodiment of the invention. The support pillow 703 is similar to the support pillow 103 in that the support pillow 703 also has a substantially toroidal shape. Additionally, similarly to the support pillow 103, the support pillow 703 is formed with opposing substantially flat surfaces 703*a* and 703*b* that are perpendicular to the axis of rotation of the toroidal shape.

However, unlike the support pillow 103, the flat support surface 703*a* of the pillow 703 is augmented by feeding elevation wedges 704*a* and 704*b* respectively. The feeding elevation wedges 704*a* and 704*b* are formed on the surface 703*a* at opposite ends of the front portion of the pillow 703. The feeding elevation wedges 704*a* and 704*b* can be formed integrally with, or separate from, the cushion portion of the pillow 703. Each of the feeding elevation wedges 704*a* and 704*b* can be used to raise the head, shoulders and neck of the infant during feeding, thereby making it easier for the infant to intake milk and enhancing the infant's digestive process. Provision of two feeding elevation wedges 704*a* and 704*b*, one at each end of the front portion of the pillow 703, enables these benefits to be obtained regardless of which breast is used for feeding.

The feeding elevation wedges 704*a* and 704*b* are located (position on the surface 703*a*) and sized (curvature, height above the surface 703*a*, and surface area of the surface 703*a* covered by the wedges 704*a* and 704*b*) so that the wedges 704*a* and 704*b* do not unduly interfere with the positioning of the feeder's elbows and forearms on the surface 703*a*, and so that the infant is comfortably supported and positioned to enhance feeding. Illustratively, the feeding elevation wedges 704*a* and 704*b* have a maximum height 705 above the surface 703*a* of approximately 2 inches. The distance 706 between the apex of the feeding elevation wedge 704*a* and the feeding elevation wedge 704*b* is, illustratively, between approximately 14 inches and approximately 20 inches.

Like the support pillow 103, the support pillow 703 can be worn with either the surface 703*a* or the surface 703*b* facing upward. As explained above, wearing the pillow 703 with the surface 703*a* facing upward is desirable when feeding a baby, since the baby is propped up by one of the feeding elevation wedges 704*a* or 704*b*. Wearing the pillow 703 with the surface 703*b* facing upward is useful for other situations, such as when reading or typing on a keyboard, in which a completely flat support surface is desirable. However, some mothers may desire to wear the pillow 703 in this latter position while feeding the baby, and the pillow 703 can be used in this way.

Though the pillow 703 includes two feeding elevation wedges, a support pillow according to the invention can include other numbers of such wedges. In one embodiment, a support pillow according to the invention includes one feeding elevation wedge.

Figure 8:
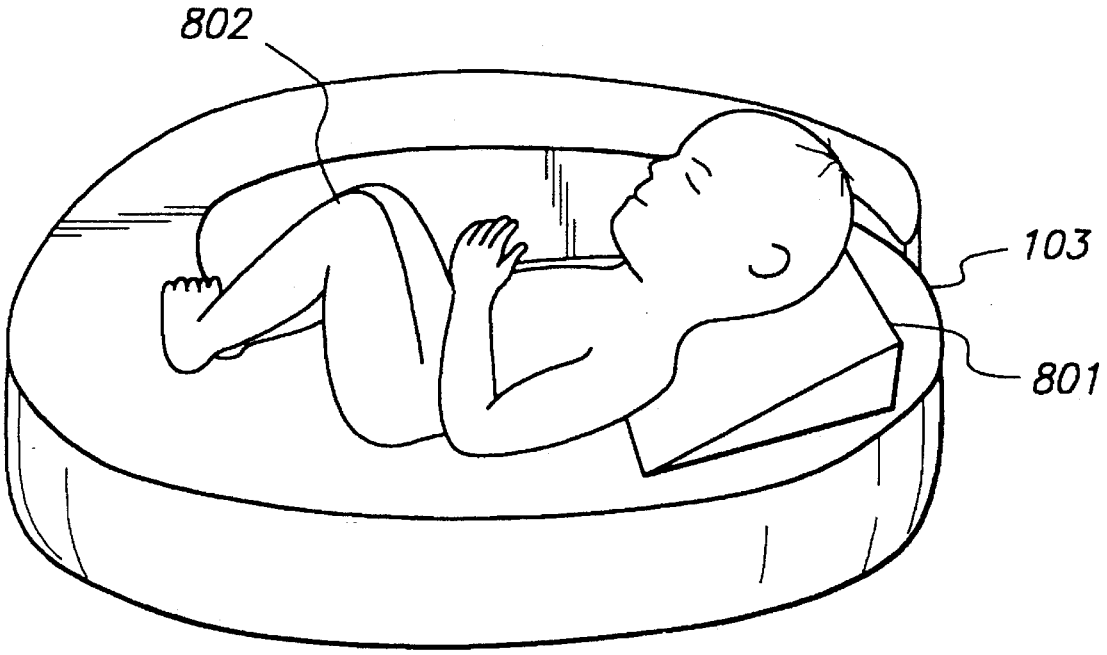
FIG. 8 is a perspective view of a support pillow according to the invention including two detachable elevations, illustrating another way in which a support pillow according to the invention can be used.

FIG. 8 is a perspective view of the support pillow 103 including a detachable feeding elevation wedge 801, illustrating another way in which the support pillow 103 can be used. In this embodiment, the feeding elevation wedge 801 is constructed in the same manner as the pillow 103, e.g., as shown in one of the FIGS. 3A and 3B, 4A and 4B, or 5A and 5B. The feeding elevation wedge can simply rest on the pillow 103, as shown in FIG. 8, or, in embodiments of the invention in which the pillow 103 includes a cover, the feeding elevation wedge 801 can be tucked inside the cover, the cover fitting sufficiently tightly so that the cover holds the feeding elevation wedge 801 in place. The feeding elevation wedge 801 is useful, for example, in supporting a baby 802 at an angle, as shown in FIG. 8, to enable the baby to feed more easily and enhance the digestive process.

FIGS. 9A through 9D are views of people using the support pillow 103 (FIGS. 1A and 1B) for various purposes other than as an aid in nursing a baby. The illustrated uses are merely illustrative; there are many other possible uses for a support pillow according to the invention.

Figure 9A:
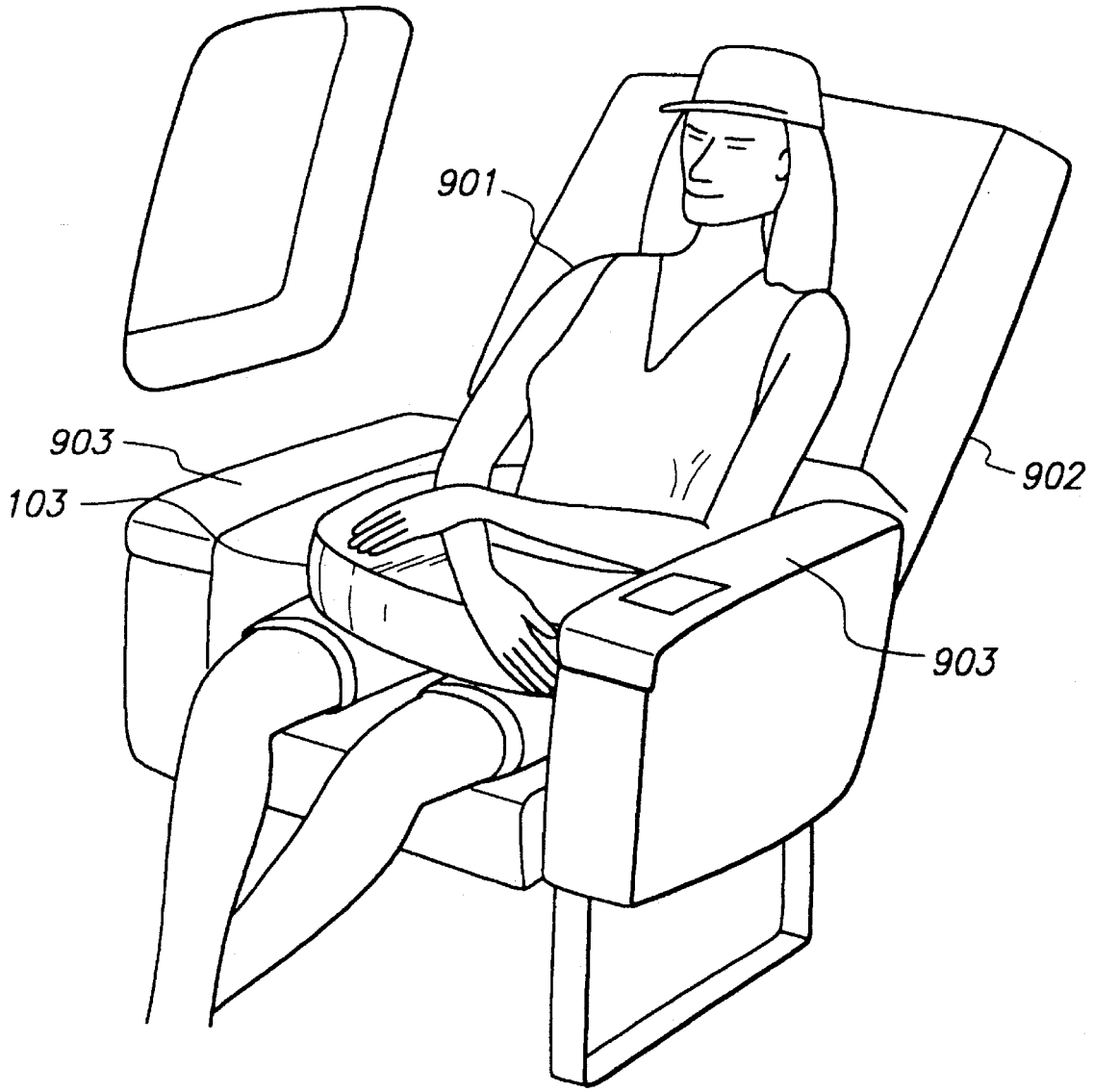
FIGS. 9A through 9D are views of people using a support pillow according to the invention in various ways.

FIG. 9A is a perspective view of a woman 901 sitting in an airplane seat 902. The pillow 103 rests in the woman's lap and provides support for her hands, forearms and elbows. Thus, the woman's arms can rest in a more natural and comfortable position than they would if she had to rest her arms on the elbow rests 903 of the seat 902. Additionally, the back portion of the pillow 103 cushions the woman's back and positions her back in a good postural position. Though not shown in FIG. 9A, the pillow 103 would also be useful for supporting a book while reading or a meal while eating.

Figure 9B:
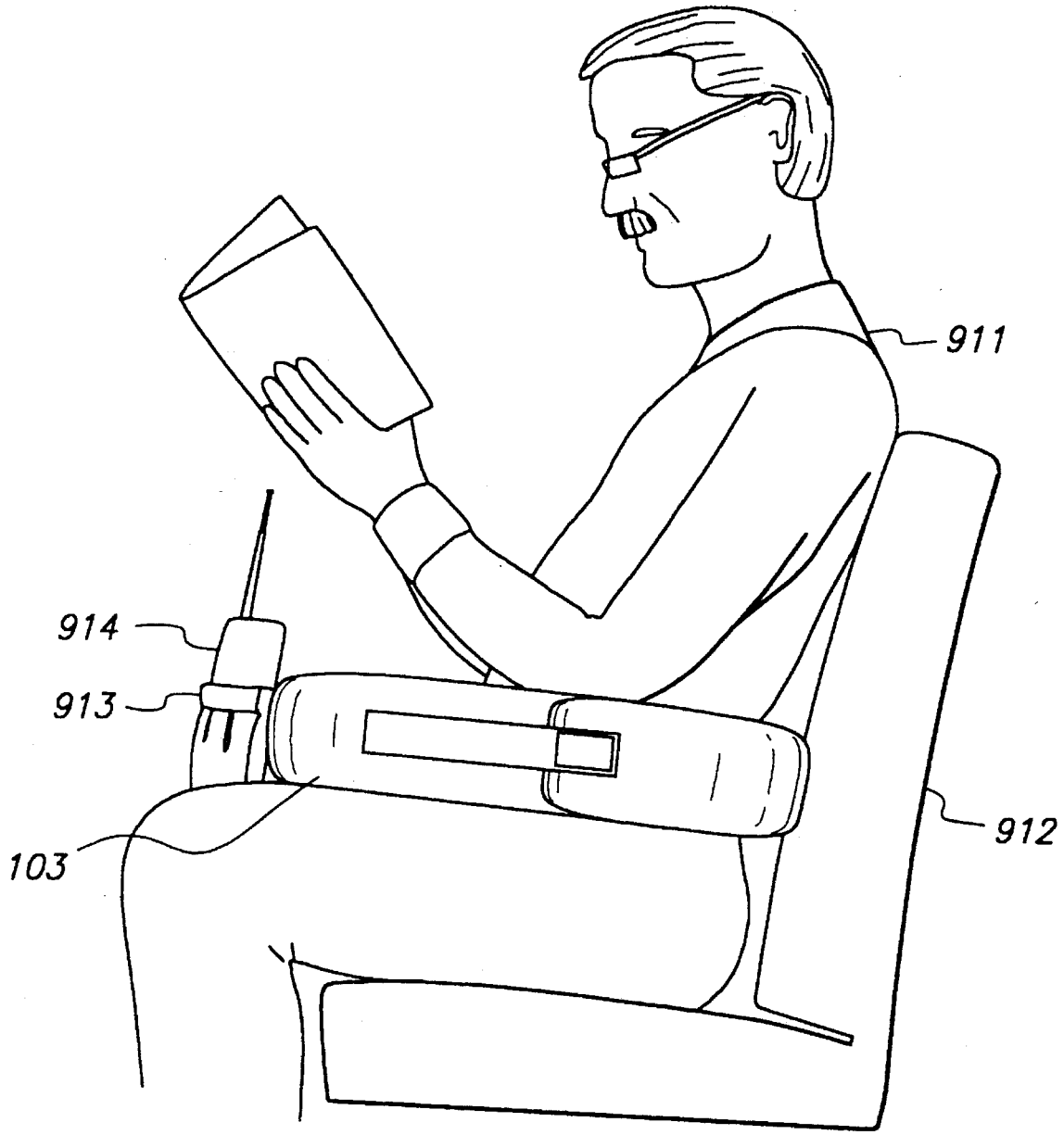

FIG. 9B is a side view of a man 911 sitting in a chair 912 while reading a book. The pillow 103 sits in the man's lap and supports the man's elbows while he reads. The back portion also provides back support and proper ergonomic positioning of the man's back. Additionally, in the embodiment of the pillow 103 shown in FIG. 9B, a looped strap 913 is attached to the pillow 103. A cordless telephone 914 is inserted between the looped strap 913 and the pillow 103 and is thereby conveniently held in place near the man while he reads.

Figure 9C:
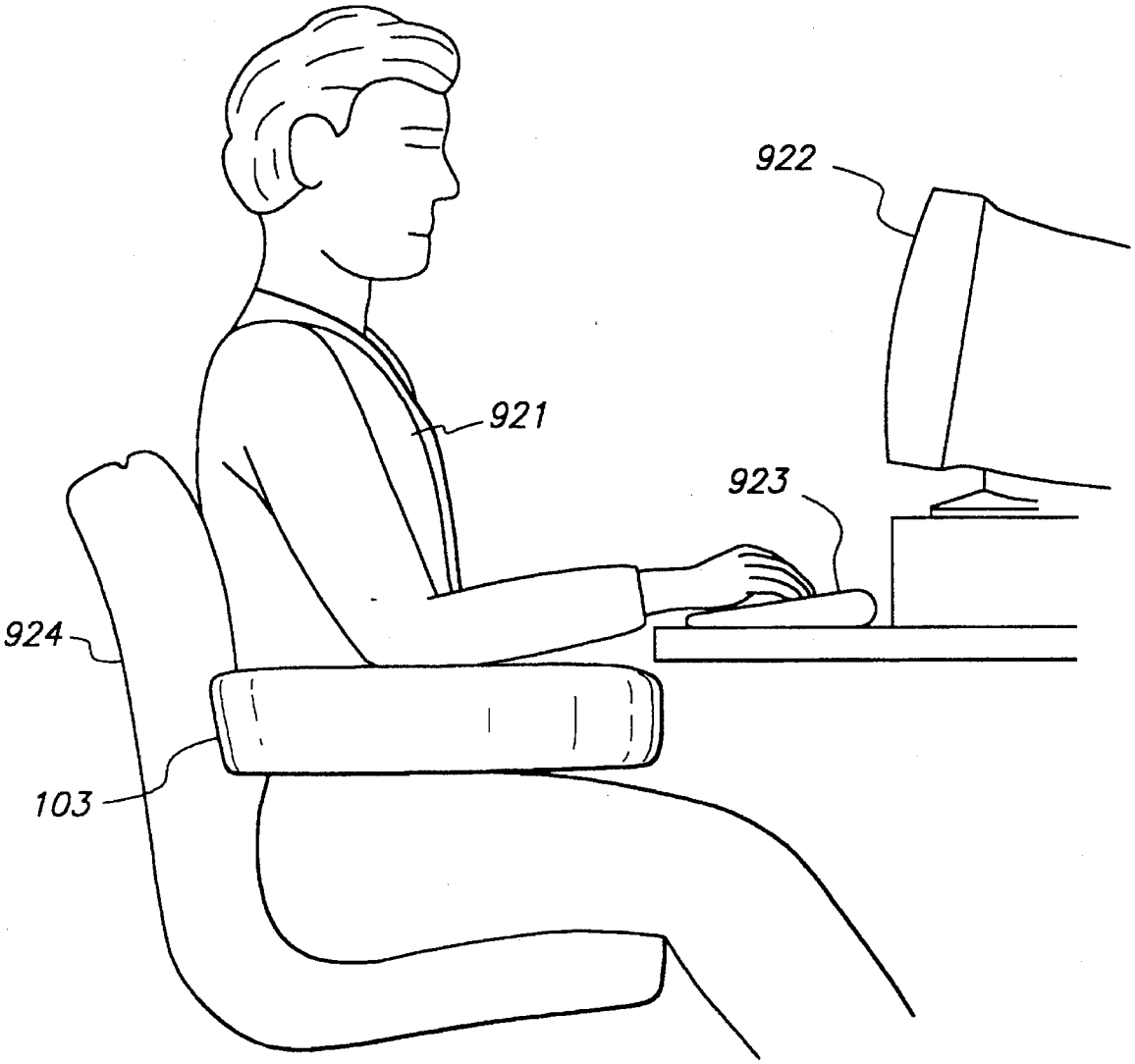

FIG. 9C is side view of a man 921 sitting in a chair 924 and working at a computer 922. The pillow 103 sits in the man's lap while he types on a keyboard 923. The pillow 103 supports the man's elbows and forearms in a position that relieves stress in the forearms during typing. The front portion of the pillow 103 (between the man's arms) can also be used to support a document while typing, or to support other supplies such as a calculator or pen. Again, as above, the back portion provides back support and aids in ergonomically positioning the man's back.

Figure 9D:
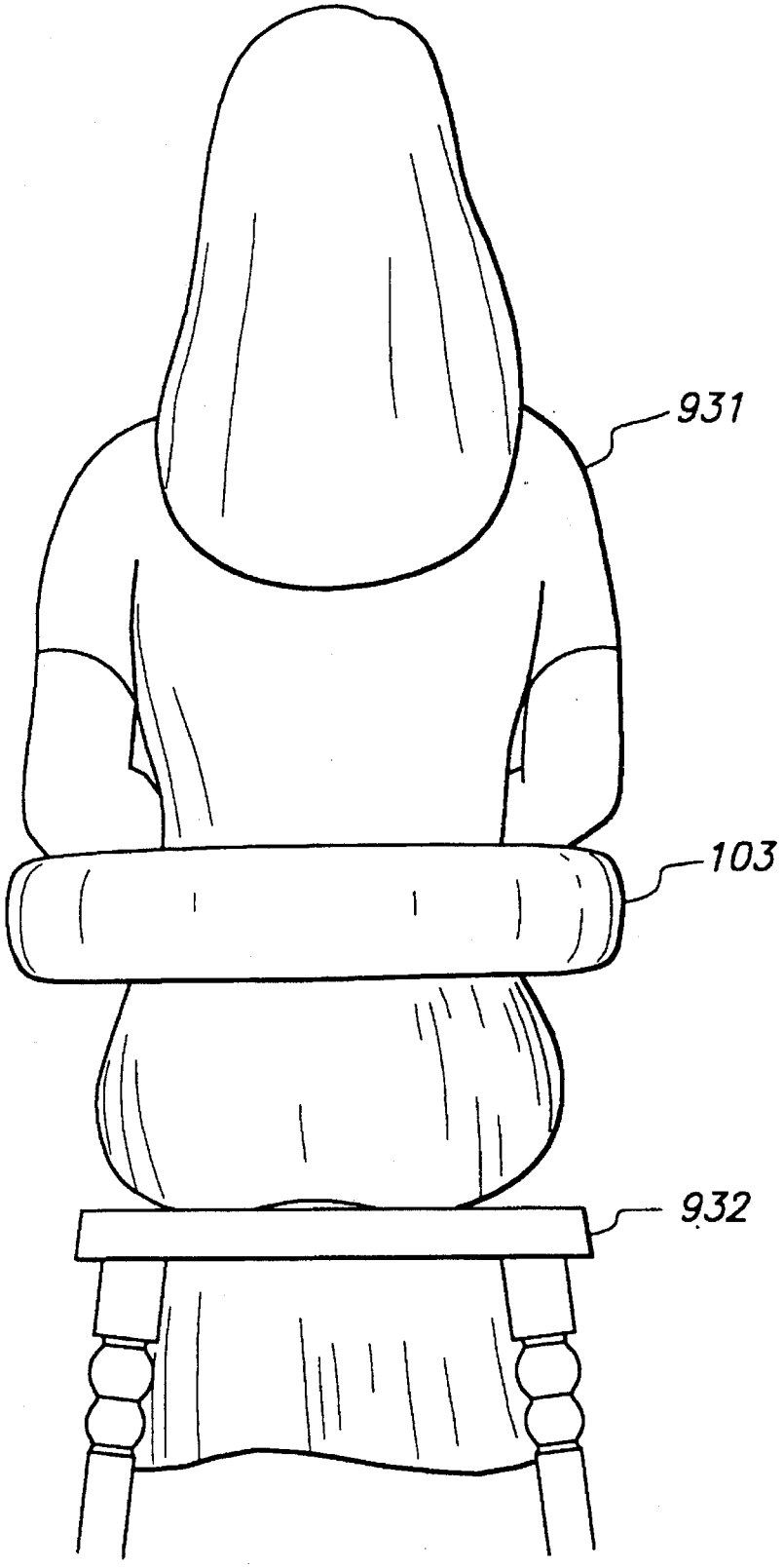

FIG. 9D is a rear view of a woman 931 sitting on a stool 932. The pillow 103 rests in the woman's lap so that she can rest her elbows and forearms on the pillow 103. Further, the back portion of the pillow 103 provides support for the woman's back, support that would otherwise be completely lacking when sitting on the stool 932. The pillow 103 also helps to force the woman to sit on the stool 932 with proper posture, thereby alleviating back strain.

Various embodiments of the invention have been described. The descriptions are intended to be illustrative, not limitative. Thus, it will be apparent to one skilled in the art that certain modifications may be made to the invention as described without departing from the scope of the claims set out below. For example, though, in the embodiments described above, the support pillow according to the invention includes a substantially solid cushion, it is to be understood that, in other embodiments, support pillows according to the invention having the characteristics described above could include an inflatable cushion.

I claim:

1. A support pillow to be worn around the waist of a user, comprising a resilient material formed in a substantially toroidal shape to define an opening through which the user's waist fits, the toroidal shape further comprising:

a front portion having a solid region with first and second ends, the front portion having a width of sufficient magnitude to enable support of an object on the front portion;

a first side portion having first and second ends, the first end of the first side portion adjacent to the first end of the front portion, the first side portion having a width of sufficient magnitude to provide support for an elbow and forearm of the user;

a second side portion having first and second ends, the first end of the second side portion adjacent to the second end of the front portion, the second side portion having a width of sufficient magnitude to provide support for an elbow and forearm of the user;

the first side portion, second side portion and front portion having constant vertical thickness;

a back portion having a solid region with first and second ends, the first end of the back portion adjacent to the second end of the first side portion, the second end of the back portion adjacent to the second end of the second side portion, wherein the back portion has a middle section whose height is greater than the height of either the front portion, first side portion or second side portion, and wherein the back portion has a width and height of sufficient magnitude to provide support in the lumbar region of the user's back;

the front portion, back portion and one of the side portions forming a single elongated pillow segment; and the front portion, first side portion, second side portion and back portion defining the opening through which the user's waist fits.

2. A support pillow as in claim 1, wherein:

the first side portion is formed in first-and second parts that are separated from each other; and the pillow is shaped such that, when the pillow is in an unstressed condition, the first and second parts are naturally biased to a closed position in which the first and second parts are adjacent to each other.

3. A support pillow as in claim 2, wherein the pillow is sufficiently flexible to allow the first and second parts to be moved away from each other to an open position in which the first and second parts are sufficiently separated to enable the waist of the user to fit through the separation into the opening.

4. A support pillow as in claim 2, further comprising means for attaching the first part to the second part.

5. A support pillow as in claim 4, wherein the means for attaching further comprises:

a strap attached to one of the first or second parts;

a first strap attachment means attached to the strap; and a second strap attachment means attached to the other of the first or second parts, the first and second strap attachment means capable of engagement to attach the first and second parts together.

6. A support pillow as in claim 1, wherein the front portion has a substantially flat surface on which the object is supported.

7. A support pillow as in claim 1 used as an aid in feeding a baby, wherein the front portion has a width sufficient to enable a baby to lie on the front portion.

8. A support pillow as in claim 1, wherein the front portion has a substantially flat surface on which the baby is supported, at least one feeding elevation wedge being formed on the flat surface to enable the baby to be supported in a feeding position.

9. A support pillow as in claim 8, wherein the front portion has a second substantially flat surface opposite the first substantially flat surface on which the at least one feeding elevation wedge is formed.

10. A support pillow to be worn around the waist of a user, the pillow being made of a resilient material formed in a substantially toroidal shape to define an opening through which the user's waist fits, wherein:

the toroidal shape is broken to form first and second ends that are separated from each other; and the pillow is shaped such that:

when the pillow is in an unstressed condition, the first and second ends are naturally biased to a closed position in which the first and second ends are adjacent to each other; and when the pillow is worn on the waist of the user, the first and second ends remain sufficiently proximate so that the pillow remains on the user's waist when the user stands or walks around;

the pillow further comprising a front portion having a solid region with a width of sufficient magnitude to enable support of an object on the front portion;

a first side portion adjacent to the front portion, the first side portion having a width of sufficient magnitude to provide support for an elbow and forearm of the user;

a second side portion opposite the first side portion, the second side portion having a width of sufficient magnitude to provide support for an elbow and forearm of the user;

the first side portion, second side portion and front portion having constant vertical thickness;

a back portion opposite the front portion having a solid region with first and second ends, the first end of the back portion adjacent to the first side portion, the second end of the back portion adjacent to the second side portion, wherein the back portion has a middle section whose height is greater than the height of either the front portion, first side portion or second side portion, and wherein the back portion has a width and height of sufficient magnitude to provide support in the lumbar region of the user's back;

the front portion, back portion and one of the side portions forming a single elongated pillow segment; and the front portion, first side portion, second side portion and back portion defining the opening through which the user's waist fits.

11. A support pillow as in claim 10, wherein the pillow is sufficiently flexible to allow the first and second ends to be moved away from each other to an open position in which the first and second ends are sufficiently separated to enable the waist of the user to fit through the separation into the opening.

12. A support pillow as in claim 10, further comprising means for attaching the first end to the second end.

13. A support pillow as in claim 12, wherein the means for attaching further comprises:

a strap attached to one of the first or second ends;

a first strap attachment means attached to the strap; and a second strap attachment means attached to the other of the first or second ends, the first and second strap attachment means capable of engagement to attach the first and second ends together.

14. A support pillow as in claim 10, wherein a portion of the toroidal shape has a substantially flat surface on which an object is supported.

15. A support pillow as in claim 14 used as an aid in feeding a baby, wherein the flat surface is sufficiently large to enable a baby to lie on the flat surface.

16. A support pillow as in claim 15, wherein at least one feeding elevation wedge is formed on the flat surface to enable the baby to be supported in a feeding position.

17. A support pillow as in claim 16, wherein a second substantially flat surface is formed opposite the first substantially flat surface on which the at least one feeding elevation wedge is formed.

18. A support pillow as in claim 10, wherein the opening has a contour that approximates the shape of a human waist.

19. A support pillow to be worn around the waist of a user to aid in feeding a baby, wherein:

the pillow is formed in a substantially toroidal shape to define an opening through which the user's waist fits;

the pillow includes a front portion having a solid support surface on which the baby is supported;

a first side portion having a width of sufficient magnitude to provide support for an elbow and forearm of the user;

a second side portion having a width of sufficient magnitude to provide support for an elbow and forearm of the user;

the first side portion, second side portion and front portion having a constant vertical thickness;

a back portion having a solid region wherein the back portion has a middle section whose height is greater than either the front portion, first side portion or second side portion and wherein the back portion has a width and height of sufficient magnitude to support the lumbar region of a user's back;

the front portion and one of the side portions forming a single elongated pillow segment; and the opening has a contour that approximates the shape of a human waist.

20. A support pillow as in claim 19, wherein:

the toroidal shape is broken to form first and second ends that are separated from each other; and the pillow is shaped such that, when the pillow is in an unstressed condition, the first and second ends are naturally biased to a closed position in which the first and second ends are adjacent to each other.

21. A support pillow as in claim 20, further comprising means for attaching the first end to the second end.

22. A support pillow as in claim 21, wherein the pillow is sufficiently flexible to allow the first and second ends to be moved away from each other to an open position in which the first and second ends are sufficiently separated to enable the waist of the user to fit through the separation into the opening.

23. A support pillow as in claim 21, wherein the means for attaching further comprises:

a strap attached to one of the first or second ends;

a first strap attachment means attached to the strap; and a second strap attachment means attached to the other of the first or second ends, the first and second strap attachment means capable of engagement to attach the first and second ends together.

24. A support pillow as in claim 23, wherein the pillow is formed of a resilient material and includes a back portion that has a width and height sufficient to cushion the user's back when pressed against a hard surface.

25. A support pillow as in claim 23, wherein the pillow is formed of a resilient material and includes a back portion that has a width and height sufficient to provide support for the user's back.

26. A support pillow to be worn around the waist of a user to aid in feeding a baby, the support pillow comprising:

a solid support surface on which the baby is supported, the support surface being substantially flat;

a first side portion having a width of sufficient magnitude to provide support for an elbow and forearm of the user;

a second side portion having a width of sufficient magnitude to provide support for an elbow and forearm of the user;

the first side portion, second side portion and front portion having a constant vertical thickness;

a back portion having a solid region wherein the back portion has a middle section whose height is greater than either the front portion, first side portion or second side portion and wherein the back portion has a width and height of sufficient magnitude to support the lumbar region of a user's back;

the front portion and one of the side portions forming a single elongated pillow segment;

a lap surface opposite the support surface, the lap surface adapted to fit comfortably against the lap of the user; and a feeding elevation wedge formed on the support surface to enable the baby to be supported in a feeding position.

27. A support pillow as in claim 26, further comprising a second feeding elevation wedge formed on the support surface, the first and second feeding elevation wedges being positioned on the support surface to enable feeding of the baby from either the right or left breast without changing the positioning of the pillow on the user.

28. A support pillow as in claim 26, wherein the lap surface is substantially flat.

29. A support pillow to be worn around the waist of a user, comprising a resilient material formed in a substantially toroidal shape to define an opening through which the user's waist fits, wherein:

the toroidal shape is broken to form first and second ends that are separated from each other;

the pillow is shaped such that, when the pillow is in an unstressed condition, the first and second ends are naturally biased to a closed position in which the first and second ends are adjacent to each other;

the pillow is sufficiently flexible to allow the first and second ends to be moved away from each other to a wearing position, the position of the first and second ends in the wearing position being determined by the size and shape of the user's waist;

the pillow further comprising a front portion having a solid region with first and second ends, the front portion having a width of sufficient magnitude to enable support of an object on the front portion;

a first side portion having first and second ends, the first end of the first side portion adjacent to the first end of the front portion, the first side portion having a width of sufficient magnitude to provide support for an elbow and forearm of the user;

a second side portion having first and second ends, the first end of the second side portion adjacent to the second end of the front portion, the second side portion having a width of sufficient magnitude to provide support for an elbow and forearm of the user;

the first side portion, second side portion and front portion having constant vertical thickness;

a back portion having a solid region with first and second ends, the first end of the back portion adjacent to the second end of the first side portion, the second end of the back portion adjacent to the second end of the second side portion, wherein the back portion has a middle section whose height is greater than the height of either the front portion, first side portion or second side portion, and wherein the back portion has a width and height of sufficient magnitude to provide support in the lumbar region of the user's back; and the front portion, first side portion, second side portion and back portion defining an opening through which the user's waist fits.

30. A support pillow as in claim 29, further comprising means for attaching the first end to the second end.

31. A support pillow as in claim 30, wherein the means for attaching further comprises:

a strap attached to one of the first or second ends;

a first strap attachment means attached to the strap; and a second strap attachment means attached to the other of the first or second ends, the first and second strap attachment means capable of engagement to attach the first and second ends together.

32. A support pillow as in claim 29, wherein the opening has a contour that approximates the shape of a human waist.

33. A support pillow to be worn around the waist of a user, comprising a resilient material formed in a substantially toroidal shape to define an opening through which the user's waist fits, the toroidal shape further comprising:

a front portion having a solid region with first and second ends, the front portion having a width of sufficient magnitude to enable support of an object on the front portion;

a first side portion having first and second ends, the first end of the first side portion adjacent to the first end of the front portion, the first side portion having a width of sufficient magnitude to provide support for an elbow and forearm of the user;

a second side portion having first and second ends, the first end of the second side portion adjacent to the second end of the front portion, the second side portion having a width of sufficient magnitude to provide support for an elbow and forearm of the user;

the first side portion, second side portion and front portion having constant vertical thickness;

a back portion having a solid region with first and second ends, the first end of the back portion adjacent to the second end of the first side portion, the second end of the back portion adjacent to the second end of the second side portion, wherein the back portion has a first and second end sections and a middle section between the first and second end sections, the height of the middle section being greater than the height of the end sections and the height of the front portion, first side portion and second side portion; and the front portion, first side portion, second side portion and back portion defining an opening through which the user's waist fits.

34. A support pillow to be worn around the waist of a user to aid in feeding a baby, wherein:

the pillow is made of a resilient material;

the pillow is formed in a substantially toroidal shape to define an opening through which the user's waist fits, the opening having a contour that approximates the shape of a human waist, the toroidal shape being broken to form first and second ends that are separated from each other, wherein:

when the pillow is not being worn by the user, the pillow is in an unstressed condition and the first and second ends are naturally biased toward a closed position in which the first and second ends are adjacent to each other;

the pillow is sufficiently flexible to allow the first and second ends to be moved away from each other to an open position in which the first and second ends are sufficiently separated to enable the waist of the user to fit through the separation into the opening; and when the pillow is worn on the waist of the user, the first and second ends remain sufficiently proximate so that the pillow remains on the user's waist when the user stands or walks around; and the pillow comprises:

a front portion, comprising:

a front support surface having a solid region for supporting the baby and the hands and forearms of the user, the support surface being substantially flat;

a lap surface opposite the front support surface, the lap surface adapted to fit comfortably against the lap of the user; and a feeding elevation wedge formed on the front support surface to enable the baby to be supported in a feeding position;

a first side portion adjacent to the front portion having a first side support surface for supporting an elbow and forearm of the user;

a second side portion opposite the first side portion having a second side support surface for supporting an elbow and forearm of the user;

the first side portion, second side portion and front portion having constant vertical thickness; and a back portion opposite the front portion having a solid region wherein the back portion has a middle section whose height is greater than the height of either the front portion, first side portion or second portion and wherein the back portion has a width and height of sufficient magnitude to provide support in the lumbar region of the user's back.

* * * * *